US006320329B1

(12) United States Patent
Wacyk

(10) Patent No.: US 6,320,329 B1
(45) Date of Patent: Nov. 20, 2001

(54) MODULAR HIGH FREQUENCY BALLAST ARCHITECTURE

(75) Inventor: Ihor T. Wacyk, Briarcliff Manor, NY (US)

(73) Assignee: Philips Electronics North America Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,214

(22) Filed: Jul. 30, 1999

(51) Int. Cl.[7] ..... G05F 1/00

(52) U.S. Cl. ..... 315/291; 315/307; 315/312; 315/297

(58) Field of Search ..... 315/312, 324, 315/307, 224, 247, 209 R, 291, 297

(56) References Cited

U.S. PATENT DOCUMENTS

| | | | | |
|---|---|---|---|---|
| 3,369,150 | * | 2/1968 | Malmin | 314/194 |
| 4,508,996 | * | 4/1985 | Clegg et al. | 315/224 |
| 4,717,863 | * | 1/1988 | Zeiler | 315/307 |
| 4,751,398 | * | 6/1988 | Ertz | 307/66 |
| 4,939,381 | * | 7/1990 | Shibata et al. | 307/17 |
| 5,107,184 | * | 4/1992 | Hu et al. | 315/291 |
| 5,323,088 | * | 6/1994 | Cunningham | 315/195 |
| 5,418,432 | * | 5/1995 | Takeuchi et al. | 315/151 |
| 5,471,119 | * | 11/1995 | Ranganath et al. | 315/307 |
| 5,485,057 | | 1/1996 | Smallwood et al. | 315/58 |
| 5,495,150 | * | 2/1996 | Zawislak et al. | 315/294 |
| 5,552,673 | * | 9/1996 | Kenwood | 315/57 |
| 5,600,211 | * | 2/1997 | Luger | 315/307 |
| 5,621,281 | * | 4/1997 | Kawabata et al. | 315/311 |
| 5,640,069 | * | 6/1997 | Nilssen | 315/209 R |
| 5,677,598 | | 10/1997 | De Hair et al. | 315/147 |
| 5,739,622 | * | 4/1998 | Zaitsu | 310/316 |
| 5,969,483 | * | 10/1999 | Li et al. | 315/225 |
| 6,031,749 | | 2/2000 | Covington et al. | 363/98 |
| 6,081,077 | * | 6/2000 | Canova et al. | 315/307 |
| 6,181,066 | * | 1/2001 | Adamson | 315/282 |

FOREIGN PATENT DOCUMENTS

| | | | |
|---|---|---|---|
| 1390592 | 10/1992 | (AU) | H05B/41/16 |
| 0395159A1 | 10/1990 | (EP) | H05B/41/29 |

* cited by examiner

*Primary Examiner*—Don Wong
*Assistant Examiner*—Tuyet T. Vo

(57) ABSTRACT

A modular high frequency ballast for two or more lamps. The modules are driven in an interleaved or non-interleaved switching manner. Independent lamp operation is provided for fixed and dimming circuits. A reduction in the size and cost of the preconditioner stage is achieved through the interleaved switching operation. The modules can be standardized for operating a broad range of lamps.

19 Claims, 4 Drawing Sheets

MODULAR HIGH FREQUENCY BALLAST ARCHITECTURE

BACKGROUND OF THE INVENTION

1. Field of the Invention

The present invention relates to fluorescent lamp ballasts and more specifically to a modular high frequency ballast used with various mains supply sources for driving different types of lamps, and for various operations of multiple lamps that are wired in series and in parallel.

2. Description of the Background of the Invention

Fluorescent lamp ballasts must serve a broad range of product requirements. These product requirements may include multiple lamp drives, for lamps ranging from one to four series and parallel wirings, instant and preheat starts, independent and non-independent operations, dimming and fixed light outputs, and operation on various mains supplies, including 120V, 277V and 240V sources. Furthermore, differing safety and Electro-Magnetic-Interference (EMI) standards in addition to driving of many different types of lamps are required for different products. As a consequence, a typical ballast producer must develop, manufacture, and stock a large number of individual product types ranging in excess of 200 Stock Keeping Units (SKUs), in order to operate as a full service supplier.

Shown in FIG. 1 is a typical multi-lamp dimming ballast system having the following components:

1. A power-factor-correction (PFC) block 2 for active power factor correction in response to a mains input 1.

2. A direct current (DC) BUS block 3 containing a large electrolytic capacitor for smoothing the voltage caused by the high-frequency load ripple current, as well as for providing a stable current supply during peak power events, e.g., ignition.

3. A regulated DC high-voltage 4 applied to the lamp inverter stage 5, which comprises a half-bridge Metal-Oxide-Silicon Field-Effect Transistor (MOSFET) power stage for driving a resonant tank circuit 6.

4. The resonant tank 6 may include multiple inductors and capacitors to achieve ballasting of more than one lamp 7. In addition a transformer may be included for isolation purposes.

5. Electrode heating is usually derived from an extra winding on an inductor a capacitor, or a separate transformer. In addition, a control integrated circuit (IC) 8 is used to generate the appropriate drive signal (level) 10 for the inverter (e.g.half-bridge configuration) 5 to achieve a desired output power level. The drive signal are gate signals supplied to the gates of the MOSFETs for turning the latter on and off. For better accuracy, the lamp output signals 9 may be sensed and compared with the control input to set the proper drive level 10.

Two problems are prevalent with the use of the lamp dimming ballast shown in FIG. 1 and described above. First, the existing systems are mostly dedicated to driving one configuration and one type of lamp. For example, in a dimming ballast, such as an Advance Mark VII type made by Advance Transformer Co. of Rosemont, Ill., from one to three lamps, series connected, may be driven. However, the values of the major tank components must be changed for each product model depending on the number of lamps and a specific lamp type. The series connection is limited by ignition voltage requirements for more than three lamps, additionally large reactive components are needed.

The same limitations hold for adjusting tank component values to the specific lamp type in the case of parallel lamp drive, such as the Philips Electronics High Frequency (HF)-R type. In addition, a balancing transformer is used in such configurations to compensate for component tolerances in low dim levels, which adds to the size and cost of the ballast.

An additional problem with existing dimming designs is the lack of Independent Lamp Operation (ILO). In the series connected situation, when a lamp is removed the entire chain is broken and all lamps are extinguished. Lamp removal, in a parallel connected lamp configuration, can activate a stop circuit that shuts down the inverter for safety reasons; again extinguishing all lamps.

To reduce the high costs of development and logistics of stocking a large number of individual product types, various approaches have been proposed, including introducing a more flexible ballast design concept, in order to significantly reduce the diversity of ballast designs. Many of these efforts have focused on the topology of a power network and specifically the combination of passive power elements.

What is needed is a modular high frequency fluorescent the lamp ballast for series and parallel lamp connections for one or more lamps. The ballast must be used for instant and preheat starts, independent and non-independent operations, dimming and fixed light outputs, and operation on various mains supply sources. Furthermore, the ballast must adhere to various safety and EMI standards required for different products and be able to drive many different types of lamps.

SUMMARY OF THE INVENTION

The present invention describes a modular power stage concept and a control method for extending a flexible ballast architecture to two or more lamps. The approach described takes advantage of the availability of the low-cost integrated silicon power modules on the one hand, and the low-cost programmable control ICs on the other. The use of modular power stages enables new methods to be used in driving the lamps, resulting in an improved functionality and flexibility, as well as providing the size and cost benefits. Specifically, the power modules may be driven independently and in an interleaved switching pattern in order to obtain independent lamp operation for fixed and dimming circuits, as well as reduced size and cost of the pre-conditioner stage. Moreover, by using standardized modules across a range of products, it is possible to build up a large volume of products while achieving better economies of scale for the key components and lower integral cost for the product line as a whole.

The inventive modular high frequency ballast includes a separate module for operating each lamp. The ballast has a multiple lamp drive capability and provides separate lamp ignition. Each module includes at least one inverter responsive to a DC high-voltage and comprising an active half-bridge transistor power stage for driving a resonant tank circuit. The ballast can further include a resonant stage LC tank circuit for forming a standard resonant output stage signal, a filament heating transformer, a power-factor-correction circuit for receiving a mains input, a direct current BUS circuit comprising a large electrolytic capacitor for smoothing the voltage caused by the high-frequency load ripple current, and for providing a stable current supply during peak power events. A control integrated circuit independently operates individual modules.

The control integrated circuit can receive external control inputs for setting a desired lamp dimming level and voltage and current information from each lamp. Furthermore, the control integrated circuit regulates each lamp by generating appropriate drive level signals and sending drive level signals to each inverter achieving a desired output power level. Additionally, the control integrated circuit senses individual lamp current levels and individually adjusts duty cycle of the driving signal for each lamp to achieve a good match, thereby eliminating the need for a balancing transformer and reducing the size and weight of the ballast.

BRIEF DESCRIPTION OF DRAWINGS

The foregoing objects and advantages of the present invention may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE PREFERRED EMBODIMENTS

Figure 2:
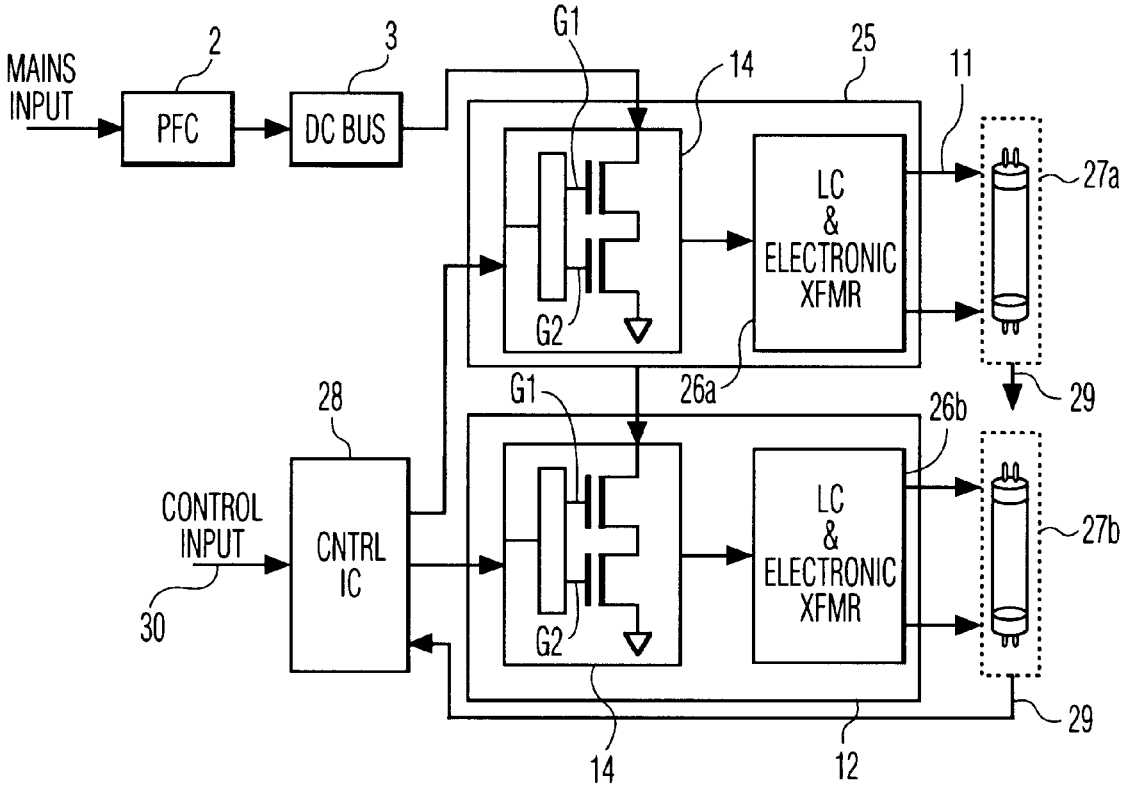
FIG. 2 is a block diagram of a two lamp ballast system in accordance with a first embodiment of the invention.

The basic system architecture of the invention for a two-lamp ballast 20 is shown in FIG. 2. The invention defines a simple one or two-lamp series driver module 25 which contains an inverter(active power stage) 14, typically of the half-bridge type, in addition to a simple LC tank circuit 26 for producing a substantially resonant signal at an output 11. This single lamp drive module is duplicated in module 12 to form a multiple lamp drive capability. A single programmable control IC 28 serves to manage the operation of ballast 20.

Figure 1:
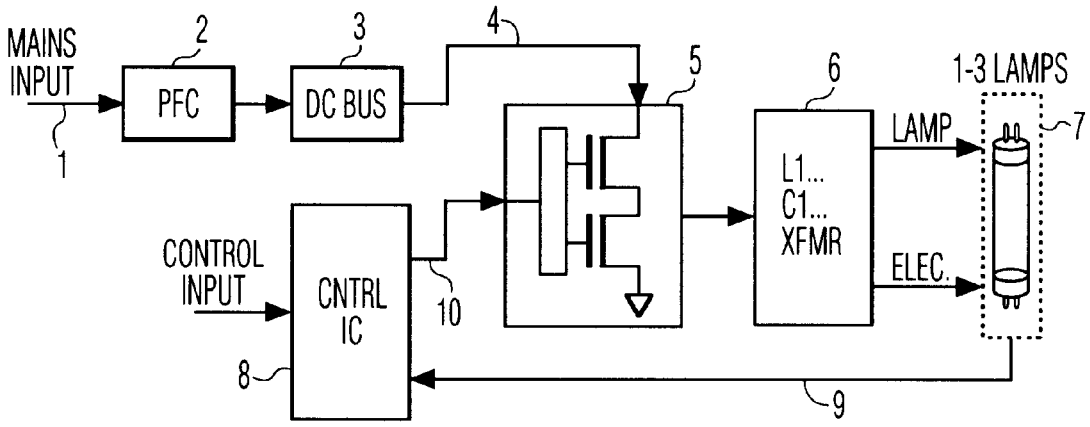
FIG. 1 PRIOR ART
FIG. 1 is a block diagram of a typical prior art multi-lamp dimming ballast system.

In addition to the PFC block 2 and the DC BUS block 3 functions described above in conjunction with FIG. 1, ballast 20 contains two identical lamp driver modules 25, 12 each comprising an integrated high voltage (HV) power IC 14, a stage 26*a*, 26*b* which includes a resonant (LC) circuit and a filament heater which can be in the form of a capacitor, winding coupled to a resonant inductor L or a separate filament heating (electrode) transformer. During steady state operation of each lamp, each inverter 14 operates at a switching frequency which is near but above the resonant frequency of the resonant(LC) circuit. The filament heating transformer can be excluded for instant start operation. Power is supplied through stage 26*a*, 26*b* to lamps 27*a*, 27*b*, respectively. Each module samples a lamp operating condition (e.g. lamp voltage and/or current) which is fed along a line 29 to the control IC 28, the latter of which independently controls the individual modules. The control IC 28 accepts an external control input 30 to set the desired lamp dimming level.

Figure 3:
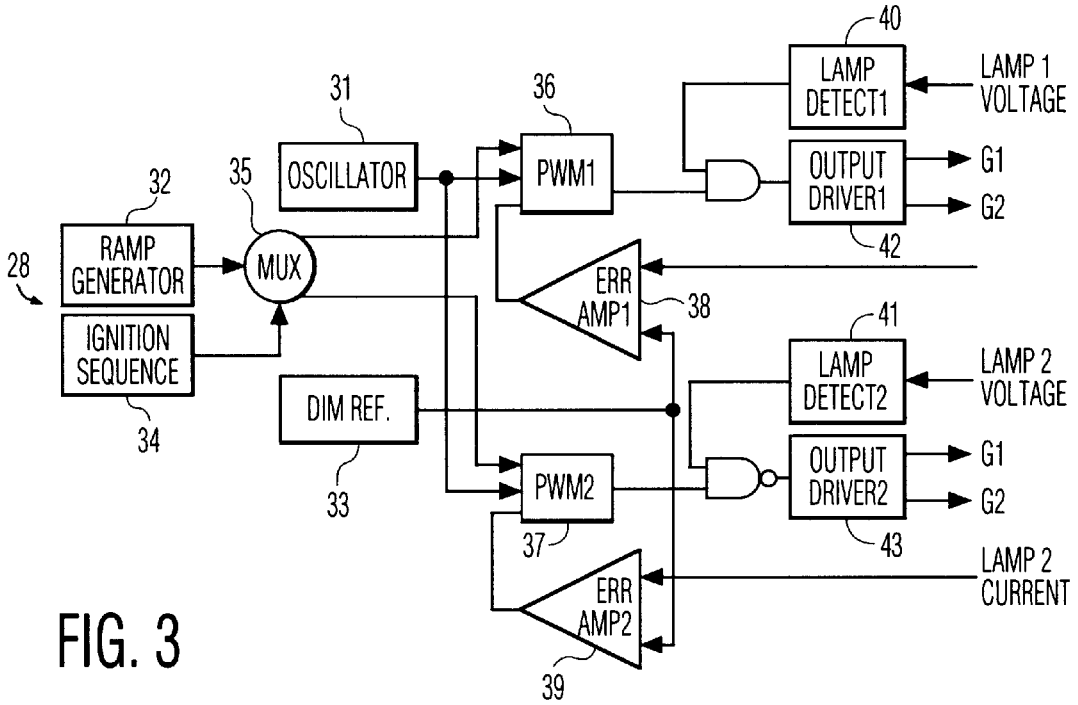
FIG. 3 is a block diagram of major functions of the control integrated circuit.

FIG. 3 shows the major functions of the control IC 28. The control IC 28 contains an oscillator 31 for setting the switching frequency, a ramp generator 32 to sweep a duty cycle for lamp ignition, a dimming reference 33 for setting the desired output light level, an ignition sequence logic block 34 and a multiplexor (MUX) function 35 to control specific lamp ignition. In addition there are two sets of Pulse Width Modulation (PWM) functions 36, 37, error amplifiers 38, 39, lamp detection circuits 40,41, and output drivers 42, 43.

The control IC 28 may set the same switching frequency and dimming reference level for both lamps in steady state operation. However, due to the duplicate set of PWMs 36, 37, Error Amplifiers 38, 39, Lamp Detectors 40, 41, and Output Drivers 42, 43, independent control is maintained over lamp burning, dimming, and ignition. The actual implementation of the control functions can be done using either analog or digital techniques.

Figure 4:
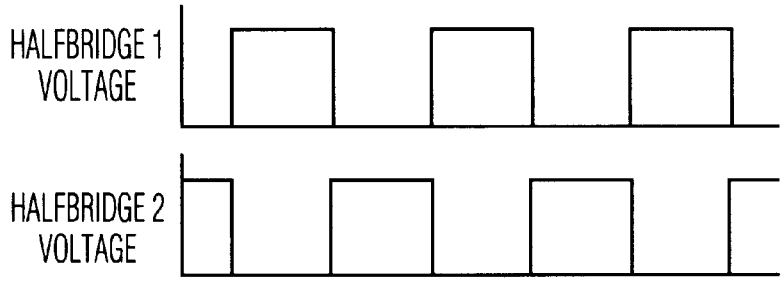
FIG. 4 is a graph of complementary drive signals provided to the two half-bridge stages from the control integrated circuit of FIG. 3.

The control IC 28 is designed to provide complementary drive signals for the inverters as shown in FIG. 4. When the inverter output is high, current is drawn from a buffer capacitor during the portion of the period that the high-side switch is in forward conduction. By driving the two inverters 180° out of phase (i.e. interleaved switching), the peak ripple current drawn from the HV buffer capacitor contained in the DC BUS block 3 (FIG. 2) is cut in half compared to a single inverter driving two lamps or two inverters operating in phase. A reduction in the size of the buffer capacitor can be realized.

Figure 3A:
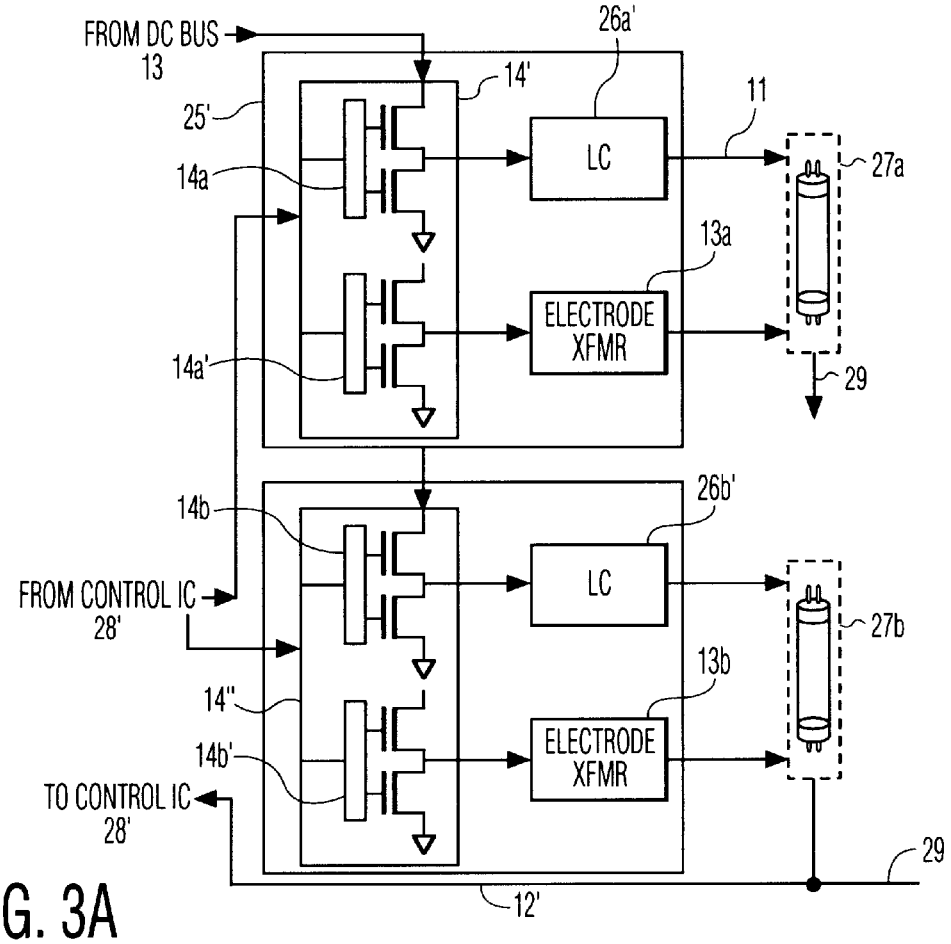
FIG. 3A is a block diagram of the module in accordance with an alternative embodiment of the invention.

In accordance with an alternative embodiment of the invention, as shown in FIG. 3A, modules 12' and 25' have inverter stages 14" and 14', respectively. Inverter stages 14' and 14" each have two half-bridge inverters 14*a*, 14*a*' and 14*b*, 14*b*', respectively. Half-bridge inverters 14*a*, 14*b* supply power through resonant (LC) circuits 26*a*', 26*b*' to lamps 27*a*, 27*b*, respectively. Filament heating is supplied through filament heating (electrode) transformers 13*a*, 13*b* to condition the filaments of lamps 27*a*, 27*b*, respectively. Control IC 28' is similar to control IC 28 but also includes additional circuitry (not shown but well known in the art) for driving inverters 14*a*', 14*b*'.

Figure 5:
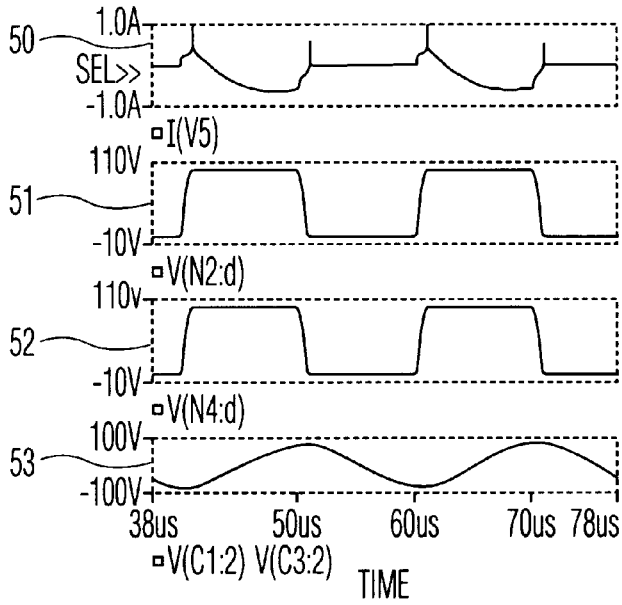
FIG. 5 is a graph of waveforms for a modular two-lamp circuit under a non-interleaved switching pattern.
Figure 6:
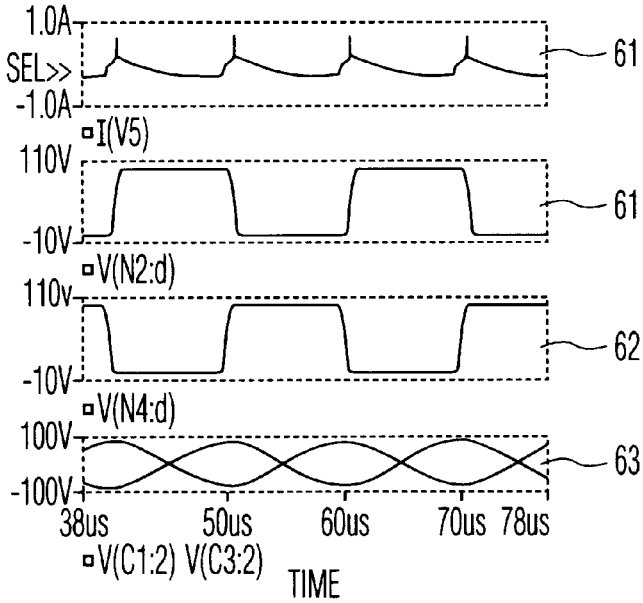
FIG. 6 is a graph of waveforms for a modular two-lamp circuit under an interleaved switching pattern.

The actual waveforms obtained from a simulation of a modular two-lamp circuit are shown in FIGS. 5 and 6 for cases of normal (i.e. in phase/non-interleaved) and interleaved switching, respectively. These figures show the input current 50, 60 supplied to the inverters 14, 14' and 14", inverter output voltages 51, 61 applied to circuits 26*a*, 26*a*', inverter output voltages 52, 62 applied to circuits 26*b*, 26*b*' and the lamp voltages 53, 63, respectively. The input current 60 (for interleaved switching) has about one-half the peak, at about twice the frequency of the input current 50 (for non-interleaved switching). The higher frequency may also result in smaller Electromagnetic Interference (EMI) filter requirements.

Figure 7:
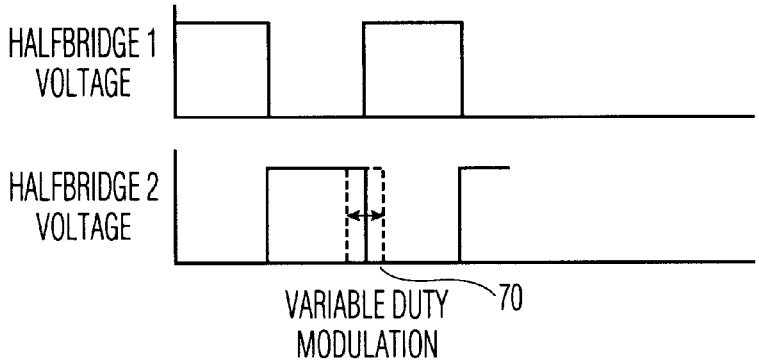
FIG. 7 is a graph of the half-bridge output waveforms generated during steady-state operation of the lamps.

The inverter (half-bridge) output waveforms shown in FIG. 7 may be generated during a steady-state operation. With two independent PWM circuits, the lamps may be operated at slightly different duty cycles 70. Small adjustments in the duty cycle 70 for one lamp relative to the other lamp may be made to compensate for component tolerances in the tank circuit elements 26 (FIG. 2) and due to parasitic wiring capacitance.

In a case of a parallel lamp output stage, a balancing transformer is typically required to achieve reasonably equal lamp dimming levels in the presence of normal component spreads in the resonant components. In this system, the individual lamp current levels are sensed by the control IC 28 and the duty cycle for each lamp is adjusted individually to achieve a good match. This eliminates the need for a balancing transformer and reduces the size and weight of the ballast.

Independent lamp drivers, furthermore, offer the possibility of igniting the lamps at slightly different times to reduce the instantaneous loading on the pre-conditioner stage. In a ballast in which the lamps are connected in series, sequential ignition is commonly accomplished with the use of a starting capacitor across one or more lamps. However, a starting capacitor affects the light balance between lamps at low dimming levels. In a parallel lamp system, the pre-conditioner stage must provide sufficient peak power to ensure that all the lamps may be ignited simultaneously. This means oversizing the components relative to the requirements for steady state operation. Neither a starting capacitor nor oversized components are required by ballast 20.

Figure 8:
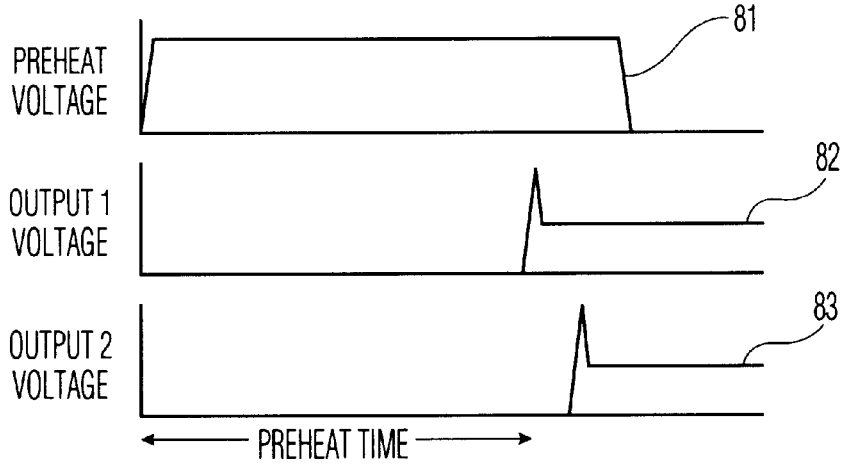
FIG. 8 is a graph of the sequential ignition waveforms during startup, comprising a filament heating waveform occurring during the preheat phase and the voltages across the two lamps.

FIG. 8 shows the filament heating waveform 81 which occurs during the preheat phase and the voltages 82, 83 across the two lamps when operated in accordance with FIG. 3A. During the preheat phase the lamp drivers are inactive and there is no voltage across either lamp.

In accordance with the invention, the modular functionality of the ballast permits sequential ignition to be achieved by delaying the ignition sweep between drivers 42 and 43. The peak power requirement for the pre-conditioner stage can be minimized. In either embodiment (FIGS. 2 or 3A), the duty cycle to one lamp driver stage is increased until sufficient lamp voltage is generated to ignite the lamp. Increase in the duty cycle occurs only after the preheat phase in the FIG. 3A circuit. An increase in voltage applied to the first lamp follows until the first lamp is its steady state mode of operation. Immediately after the first lamp is in its steady state mode of operation, the second lamp inverter is swept to ignite the second lamp followed by an increase in voltage applied to the lamp so as to place the second lamp in its steady state mode of operation. By not attempting to ignite the lamps at substantially the same time, the peak power required from the pre-conditioner is minimized, resulting in a potential size and cost savings.

Figure 9:
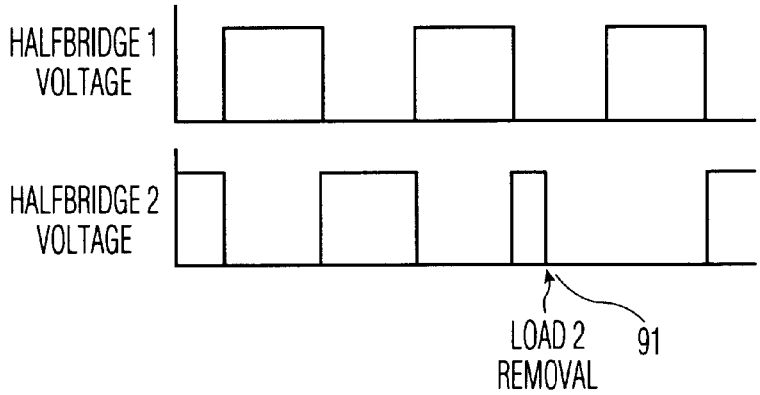
FIG. 9 is a graph of voltage waveforms when one lamp is removed.

Separate lamp ignition may also be required in order to provide ILO. For example, when a lamp has been removed and then replaced while the other lamp continues to burn. A separate ignition sweep may ensure that the replaced lamp will be ignited. Furthermore, ILO requires when one lamp is removed from the ballast, that the remaining lamp continue burning. This may be achieved with the modular system described above. FIG. 9 shows voltage waveforms when one lamp is removed. In this case the lamp connected to stage 2 was removed at a point in time identified by reference numeral 91.

Upon the lamp removal, a Lamp Detect function 40, 41 (FIG. 2) recognizes that a lamp is no longer present. This is generally achieved by sensing whether the output voltage is greater for the unloaded output stage 11 than it is when the lamp is present. When the lamp is no longer present, the inverter associated with that lamp is stopped/no longer operated (i.e. driven by control IC 28). Since the output voltage of the module which is unloaded (e.g. no lamp present) is reduced to zero, it is possible to combine safety with independent lamp operation without the need for an isolation transformer. This may result in a further miniaturization and reduction in cost of the ballast.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims. For example, the invention need not include PFC block 2 and DC Bus block 3 but rather can include circuitry for supplying a DC voltage, regulated or unregulated, to modules 12 and 14. Similarly, coupling of each inverter output to a lamp need not include a resonant LC circuit but rather any suitable current limiting element (e.g. an inductor, capacitor, or non-resonant combination of an inductor and capacitor).

Having thus described our invention, what I claim as new, and desire to secure by Letters Patent is:

1. A modular high frequency ballast for powering at least two lamps, comprising:

a module for each lamp, each module including at least one inverter; and a controller for independently operating each module, said controller responsive to at least one feedback signal from each lamp, each feedback signal corresponding to at least one of a lamp voltage and a lamp current of each lamp, and the controller being configured to generate driving signals for controlling the switching frequency of each inverter;

wherein:

at least two modules are operated substantially 180° out of phase from each other and the controller, in response to the feedback signal, adjusts duty cycles of the driving signals supplied to each inverter.

2. The ballast of claim 1, wherein the controller is further responsive to a signal representing a desired lamp dimming level.

3. A method for individually operating two lamps from one ballast, comprising:

supplying a first driving signal to a first inverter for igniting a first of the two lamps;

continuing to supply the first driving signal to the first inverter for increasing the voltage applied to the first of the two lamps following its ignition until the first of the two lamps reaches steady state operating conditions;

supplying a second driving signal to a second inverter for igniting a second of the two lamps only after the first of the two lamps reaches its steady state operating conditions;

continuing to supply the second driving signal to the second inverter for increasing the voltage applied to the second of the two lamps following its ignition until the second of the two lamps reaches its steady state operating conditions.

4. The method of claim 3, further including operating the first and second inverters substantially 180° out of phase from each other.

5. A modular high frequency ballast for powering at least two lamps, comprising:

a module for each lamp, each module including at least one inverter; and a controller for independently operating each module,
said controller responsive to at least one feedback signal from each lamp,
each feedback signal corresponding to at least one of a lamp voltage and a lamp current of each lamp.

6. The ballast of claim 5, wherein the at least one feedback signal includes lamp voltage and lamp current.

7. The ballast of claim 5, wherein the inverter is of the half-bridge type.

8. The ballast of claim 5, further including:

a power-factor-correction circuit for receiving a power input; and a direct current BUS circuit comprising
an electrolytic capacitor that is configured
to smooth the voltage caused by the high-frequency load ripple current, and
to provide a stable current supply during peak power events.

9. The ballast of claim 5, wherein the at least two modules are operated about 180° out of phase from each other.

10. The ballast of claim 5, wherein the controller is further responsive to a signal representing a desired lamp dimming level.

11. The ballast of claim 5, wherein the controller generates driving signals for controlling a switching frequency of each inverter.

12. The ballast of claim 11, wherein the controller is configured to sense the individual lamp current levels and to adjust the duty cycles of the driving signals supplied to each inverter.

13. A modular high frequency ballast for powering at least two lamps, comprising:

a module for each lamp,
each module including at least one inverter; and a controller for independently operating each module,
said controller responsive to at least one feedback signal from each lamp,
each feedback signal corresponding to at least one of a lamp voltage and a lamp current of each lamp;

wherein
at least one module further includes
a filament heating transformer and
a resonant LC circuit, at least one module including a first inverter and a second inverter, wherein
the first inverter supplies power through the resonant LC circuit to illuminate a first lamp and
the second inverter supplies power through the filament heating transformer to condition the first lamp during a preheat phase of the first lamp.

14. The ballast of claim 13, wherein the inverter is of the half-bridge type.

15. The ballast of claim 13, further including:

power-factor-correction circuit for receiving a power input; and a direct current BUS circuit comprising
an electrolytic capacitor that is configured
to smooth the voltage caused by the high-frequency load ripple current, and
to provide a stable current supply during peak power events.

16. The ballast of claim 13, wherein the at least two modules are operated substantially 180° out of phase from each other.

17. The ballast of claim 13, wherein the controller is further responsive to a signal representing a desired lamp dimming level.

18. The ballast of claim 13, wherein the controller generates driving signals for controlling a switching frequency of each inverter.

19. The ballast of claim 18, wherein the controller is configured to sense the individual lamp current levels and to adjust the duty cycles of the driving signals supplied to each inverter.

* * * * *